US011324659B1

(12) United States Patent
Campbell

(10) Patent No.: US 11,324,659 B1
(45) Date of Patent: May 10, 2022

(54) BATHING INSTALLATION FITTING AND GROMMET ASSEMBLY

(71) Applicant: Balboa Water Group, LLC, Costa Mesa, CA (US)

(72) Inventor: Graham J. Campbell, Irvine, CA (US)

(73) Assignee: Balboa Water Group, LLC, Costa Mesa, CA (US)

( * ) Notice: Subject to any disclaimer, the term of this patent is extended or adjusted under 35 U.S.C. 154(b) by 0 days.

(21) Appl. No.: 17/076,710

(22) Filed: Oct. 21, 2020

(51) Int. Cl.
*A61H 33/00* (2006.01)
*A47K 3/02* (2006.01)

(52) U.S. Cl.
CPC ..... *A61H 33/6063* (2013.01); *A47K 3/02* (2013.01)

(58) Field of Classification Search
CPC .. A61H 33/6021; A61H 33/6063; E04H 4/12; E04H 4/148; E04H 4/169; F16L 41/088
See application file for complete search history.

(56) References Cited

U.S. PATENT DOCUMENTS 3,033,624 A * 5/1962 Biesecker ..... F16C 11/04 384/125
5,029,879 A * 7/1991 Strang, Sr. ..... F16L 41/088 277/606
5,397,206 A * 3/1995 Sihon ..... F16F 7/00 411/970
5,920,924 A * 7/1999 Pinciaro ..... A61H 33/027 4/541.6
6,192,531 B1 * 2/2001 Fritz ..... E03C 1/24 138/90
6,453,484 B1 * 9/2002 Pinciaro ..... A61H 33/6063 4/541.6
7,918,486 B2 * 4/2011 Preisendorfer ..... F16L 41/088 285/216
10,611,008 B2 * 4/2020 Pugliese ..... E04H 4/14
2014/0300061 A1 * 10/2014 Gopireddy ..... F28F 9/06 277/607

* cited by examiner

*Primary Examiner* — David P Angwin
*Assistant Examiner* — Nicholas A Ros
(74) *Attorney, Agent, or Firm* — Larry K. Roberts

(57) ABSTRACT

A fitting assembly for installation in an opening in a tub shell wall of a bathing installation tub. A resilient grommet is sized to be inserted into the opening and has an interior peripheral recess defined in a wall portion, having a recess cross-sectional configuration. A fitting body has a protruding external rib having a rib cross-sectional configuration complimentary to the recess cross-sectional configuration, the rib positioned on the fitting body so that when the fitting body is inserted into the grommet, the rib is received into the recess on the grommet. The grommet and fitting are configured such that the recess and the rib are positioned behind the back surface of the shell wall when installed in the opening, and the grommet is compressed by the edge of the shell opening and pushed outwardly by the rib to lock the fitting into the shell opening.

16 Claims, 4 Drawing Sheets

BATHING INSTALLATION FITTING AND GROMMET ASSEMBLY

BACKGROUND

Bathing installations such as spas and whirlpool baths have tubs for holding the bathing water which are typically fabricated from fiberglass in a mold. The bathing installation typically utilizes various fittings which are installed in openings formed through the tub wall. The openings may be drilled through the tub wall or formed during the molding process. The fittings include, for example, water and air jets, control panels, on-off switch buttons, audio speakers, to name a few.

Some spa tubs may have several dozen spa jets, typically installed in holes drilled through the spa tub, in additional to other fittings. The installation of the fittings using conventional techniques can be time-consuming and labor intensive. The installation should ensure that the fittings do not leak. Spa jet fittings are typically attached to water lines on the back side of the tub, which add weight which is supported by the fitting. Even though the fittings do not leak initially after the installation, over time, the weight, vibration and temperature changes associated with use tends to cause leaks, typically through the openings in the tub wall surrounding the fitting.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
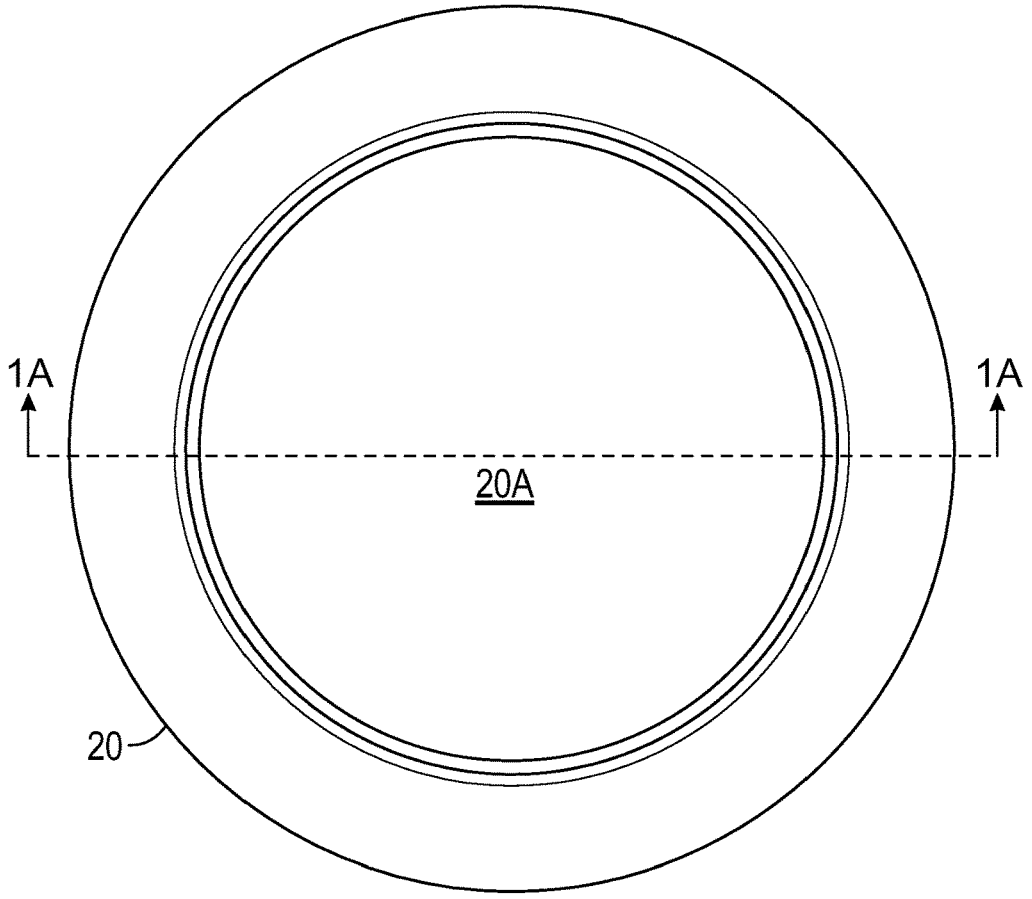
FIG. 1 is a top plan view of an exemplary embodiment of a grommet for use with a bathing installation fitting.
Figure 1A:
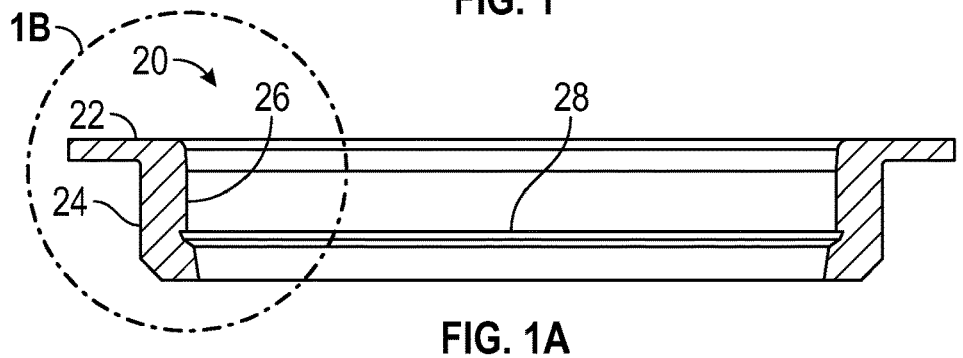
FIG. 1A is a cross-sectional view of the grommet, taken along line A-A of FIG. 1.

In the following detailed description and in the several figures of the drawing, like elements are identified with like reference numerals. The figures may not be to scale, and relative feature sizes may be exaggerated for illustrative purposes.)

The typical jet body has external threads. It is placed through a hole and secured with a nut that is tightened into place to a specific torque. It may also have a compensating ring to account for the undulating surface on the back of the tub shell and may also have a gasket or silicone to seal the underside lip of the jet body to the inside surface of the tub vessel.

Another method of installing the jet into a tub shell can be with a grommet. In this instance the jet body does not have external threads but a smooth external surface. The grommet with a smooth internal surface is placed through a hole in the tub shell. The grommet typically has an ID (inner diameter) that is smaller than the OD (outer diameter) of the jet body. The jet body exterior is lubricated with water or soapy water and forced through the ID of the grommet. Upon the forcible insertion of the jet body through the grommet the grommet is forced outward and the external force creates a seal between the grommet and the ID of the hole in the tub shell. If pressure is applied from the rear of the jet body the jet body can be extracted from the grommet of the jet body and grommet seal can be compromised and leaks can occur.

To address the shortcomings of the conventional installation techniques, in accordance with aspects of the invention, a fitting, for example a jet body, and a grommet assembly are provided with unique features. Exemplary embodiments of the fitting and grommet assembly are illustrated in FIGS. 1-5.

Figure 1B:
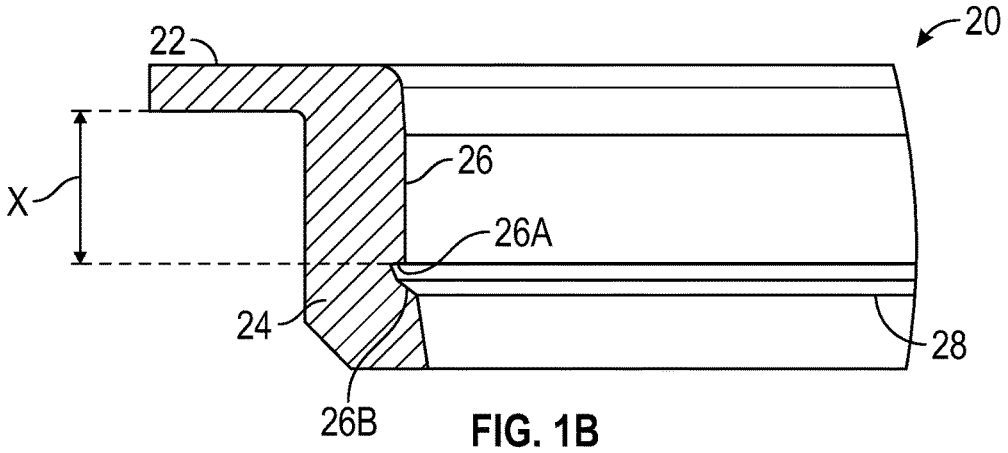
FIG. 1B is a cross-sectional, detail view of a portion of the grommet of FIGS. 1 and 1A.

In an exemplary embodiment, the grommet 20 of FIGS. 1-1B is fabricated of a resilient material such as ethylene propylene diene monomer (EPDM) or other elastomer, and in this example has a circular peripheral configuration to fit in a hole bored or formed in a tub shell wall. For other embodiments, the grommet may have a different peripheral configuration, such as rectilinear, oblong or elliptical, to match the shape of the corresponding fitting peripheral configuration and that of the opening in the tub shell wall. The grommet 20 includes a grommet wall portion 24 surrounding opening 20A, and a flange portion 22 extending outwardly from a top portion of the wall portion. The flange portion 22 is configured to extend over a portion of the shell wall adjacent the opening when the grommet is positioned within the shell wall opening.

In accordance with an aspect of the invention, the grommet 20 has an internal peripheral recess 26, in this example a radial recess, of a unique shape. The recess 26 has a flat surface 26A on the top and an inwardly tapered surface 26B below the surface 26A. The recess is at a position "x" (FIG. 1B) spaced from the flange portion far enough that, when the grommet 20 is inserted through the wall of a typical tub shell, the recess portion of the grommet is at a position beyond the back surface of the tub shell. In an exemplary embodiment, the dimension of position "x" is at least ¼ inch.

Figure 2B:
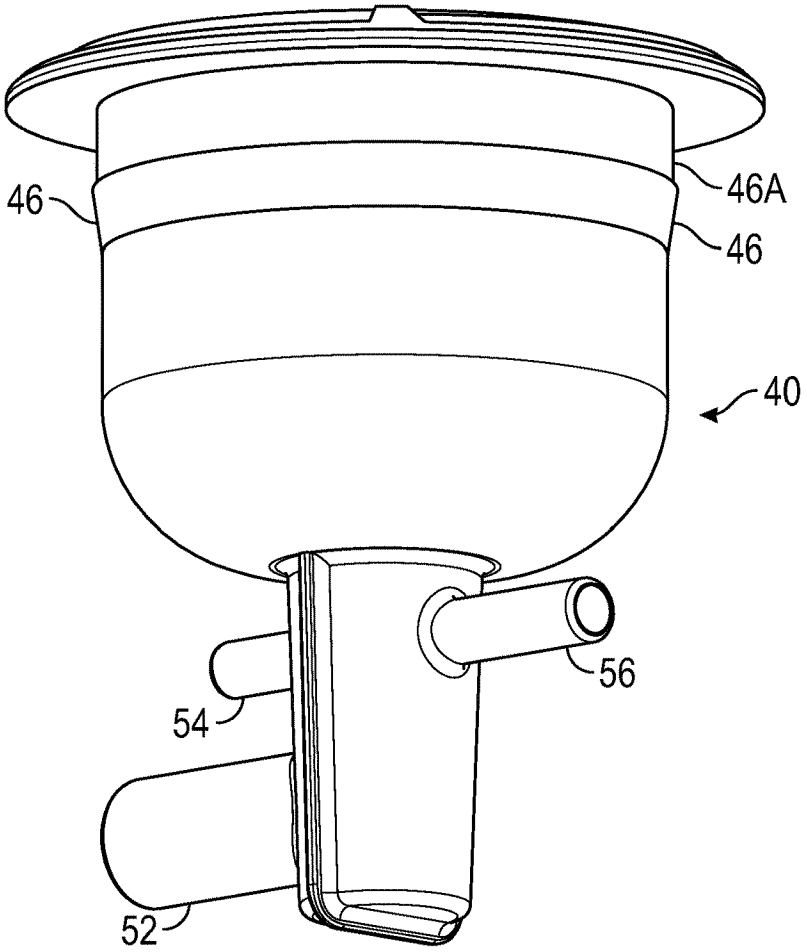
FIGS. 2A and 2B are respective upper and lower isometric views of an exemplary embodiment of a bathing installation fitting, a spa jet body, configured for use with the grommet of FIG. 1.
Figure 2A:
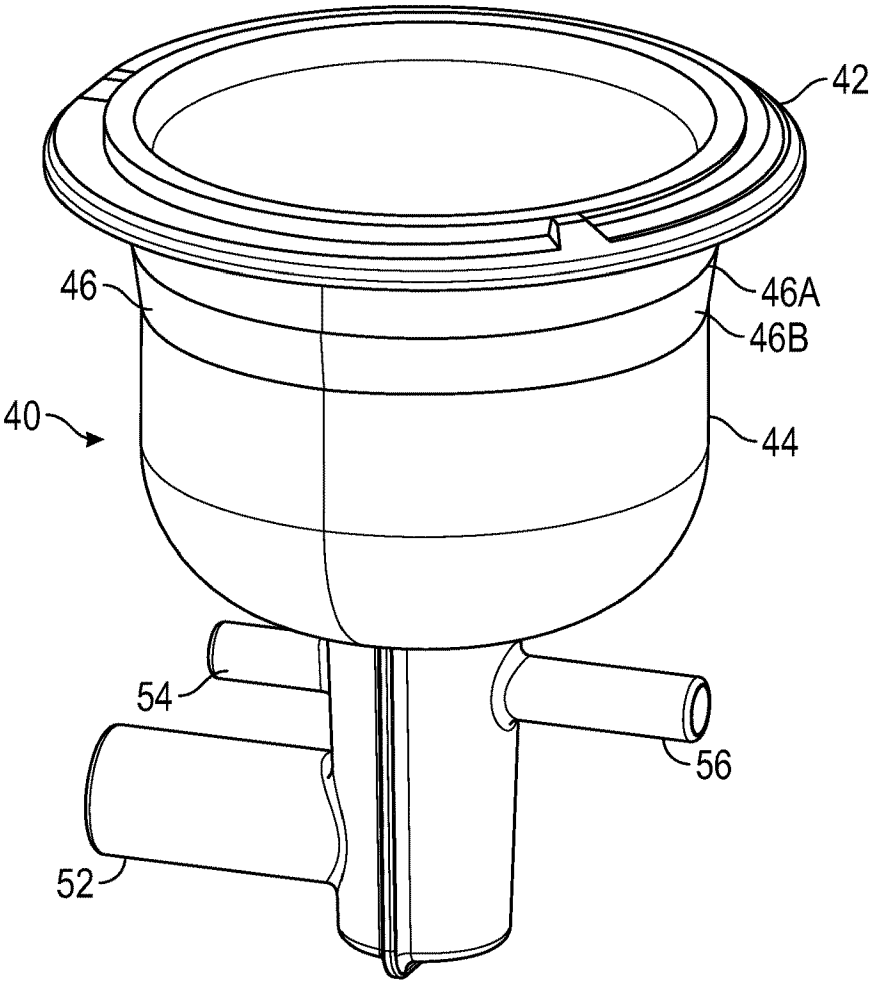

FIGS. 2A-2B illustrate an exemplary fitting body 40 of a first embodiment of a fitting and grommet assembly. In this example, the fitting body 40 is a jet body 40, with a peripheral wall portion 44 and a top flange portion 42 extending outwardly from the top of the wall portion. The body 40 in this example receives a jet structure (not shown) and has port 52 for connection to a water hose, a port 56 for connection to an air hose, and a structure 54 for receipt of a light. Other fittings may have a different configuration. The flange portion is configured to extend over the grommet flange and the tub shell about the periphery of the shell opening to receive the fitting.

In this exemplary embodiment, the outer periphery of fitting body wall 44 has a protruding rib 46 running radially on the exterior surface of the jet body. The rib has a unique profile; the rib is flat on the top portion 46A and has a tapered portion 46B below. The rib 46 is positioned on the fitting body 40 so that when the fitting body is inserted into the grommet, the peripheral rib 46 of the body 40 will lock into the peripheral recess 26 on the grommet 20. The grommet typically has an ID (inner diameter) that is smaller than the OD (outer diameter) of the jet body.

In a general sense, the grommet recess and the fitting body rib or projection have complimentary cross-sectional configurations, so that the rib fits into the recess. The recess and rib may have different configurations that those described for the illustrated embodiment of FIGS. 1-4, such as concave/convex, rectilinear, or other complimentary configurations. The exemplary configurations of FIGS. 1-4 provide a barb-like lock 24A which may provide more resistance to retraction of the fitting body and grommet when installed in the shell opening than other configurations.

In another embodiment, the grommet and fitting assembly has a grommet projection and a corresponding fitting body recess.

In an exemplary embodiment, for a shell hole having a 3 and 31/32 inch diameter, a fitting body having a 3.49 inch diameter, the grommet wall has a 0.275 inch thickness.

Figure 3:
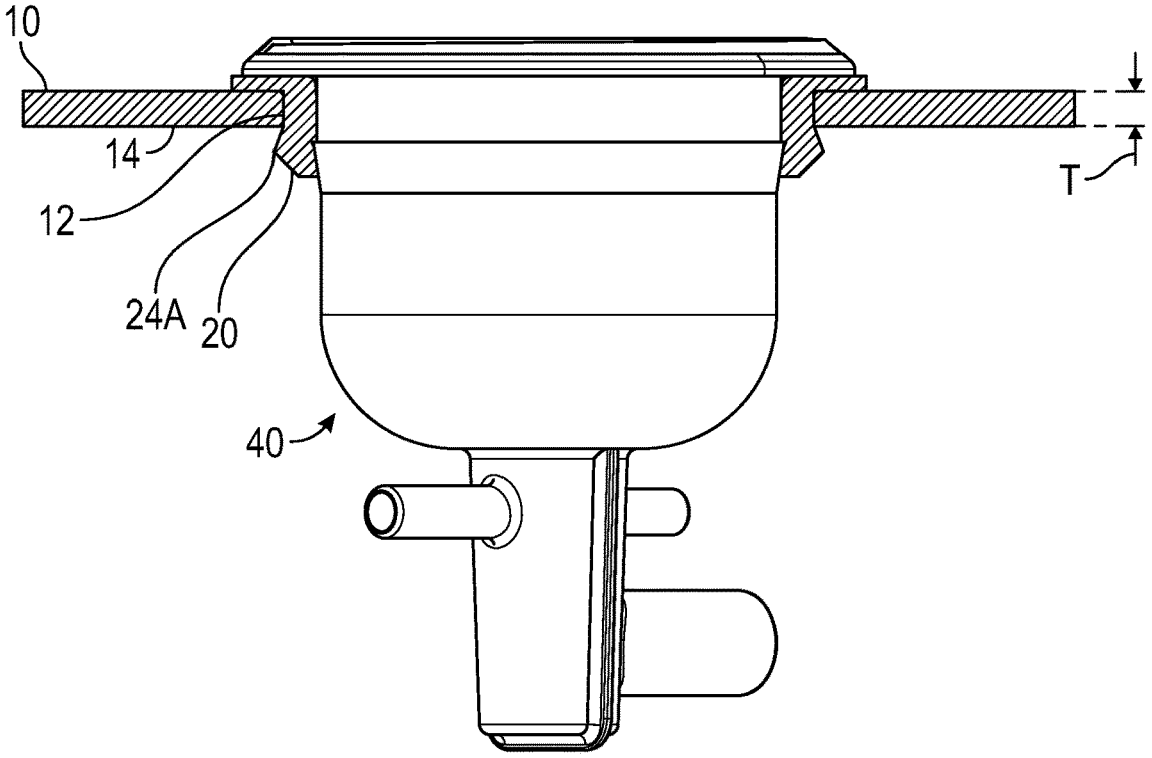
FIG. 3 is a diagrammatic cross-sectional view of the tub shell and grommet of FIG. 1, with the fitting of FIG. 2 installed in the tub shell.

FIG. 3 is a cross-sectional view of the fitting 40 and grommet 20 installed in an opening 12 formed in a tub shell 10. The grommet is typically lubricated with water or dishwashing soap to facilitate ease of installation.

The shell has a thickness T in the area of the opening 12. In an exemplary embodiment of a spa tub wall, the thickness T is approximately 0.25 inch. The radial recess 26 of the grommet and the rib 46 are positioned below the back surface 14 of the shell when installed in the opening. The grommet is compressed by the edge of the shell opening and in the unrestrained region below the shell wall is pushed outwardly by the rib 46 to form a protrusion area 24A below the back surface 14 of the shell 10 to lock the fitting within the shell opening.

Following are exemplary features of the fitting body 40 locking into the recess 26 on the grommet 20.

i) The unique complimentary shapes of the fitting body rib 46 and the recess 26 in the grommet 20 work together as a lock to resist the extraction of the jet body from the grommet. When pushed from behind, the lock resists the fitting body pull out from the grommet.

ii) When the fitting body 40 is installed in the grommet 20, the external radial rib 46 on the jet body pushes out the unrestrained grommet (at protrusion 24A under the tub shell) as illustrated in FIG. 3, and increases the grommet OD below the hole in the tub shell and this also creates resistance to the jet body and grommet popping back into the inside of the tub shell.

On a spa in normal use, the water pipes connected to a jet body can cantilever from the jet body and they have weight from the entrained water. With the addition of excess summer heat, the conventional grommet/jet design has been known to creep out of the hole back towards the inside of the tub shell and leaving the opportunity for leaking to occur.

Figure 4:
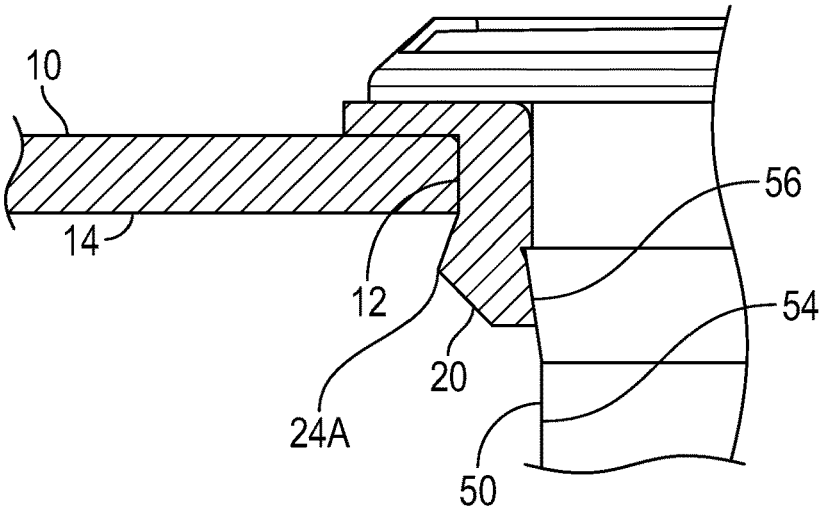
FIG. 4 is a cutaway cross-sectional view of a bathing installation fitting installed in a tub shell wall with a grommet.

FIG. 4 illustrates a bathing installation fitting 50 installed in a tub shell way 10 with a grommet 20. The fitting has an external rib 56 protruding from the fitting wall 54 as with the jet fitting body illustrated in FIGS. 2 and 3. The fitting 50 is one of water or air jets, control panels, on-off switch buttons, audio speakers, air controls, suction fittings, valves, water features, and ozone fittings.

Figure 5:
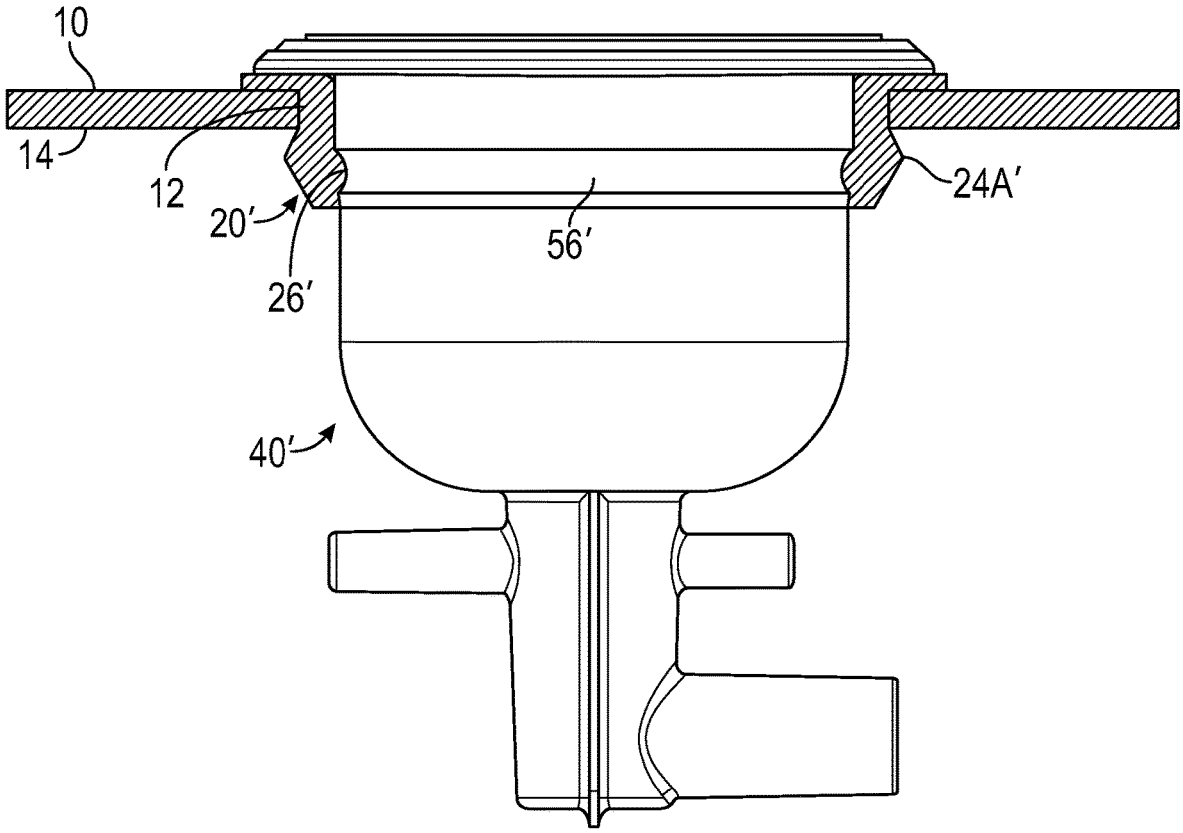
FIG. 5 is a diagrammatic cross-sectional view of the tub shell and an alternate embodiment of a grommet, installed in the tub shell with a fitting.

In an alternate embodiment of a complimentary grommet and fitting body arrangement illustrated in FIG. 5, the grommet 20' has an ID projection 26' and the fitting 40' has a corresponding recess 56'. As with the embodiment of FIGS. 1-4, the projection and recess are spaced to be passed through the shell on installation and be positioned below the back surface 14 of the tub shell. The projection 26' has a configuration which is complimentary to the recess 56' so that the projection fits into the recess. The unique complimentary shapes of the fitting body recess 46' and the projection 26' from the grommet 20' work together as a lock to push out the grommet at 24A' to resist the extraction of the jet body from the grommet. When pushed from behind, the lock resists the fitting body pull-out from the grommet.

Shapes of the projection 26' and the recess 56' other than those shown in FIG. 5 may alternatively be employed.

The grommet and fitting body assemblies disclosed herein reduce the number of components needed to assemble the fitting to the tub shell and also eliminate the need to correctly tighten/torque the securing nut to secure the typical fitting body design, while at the same time eliminating or substantially reducing the risk of the fitting body and grommet creeping out the shell hole towards the inside of the shell.

Although the foregoing has been a description and illustration of specific embodiments of the subject matter, various modifications and changes thereto can be made by persons skilled in the art without departing from the scope and spirit of the invention.

What is claimed is:

1. A fitting assembly for installation in an opening in a tub shell wall of a bathing installation tub having an interior surface, a back surface and an edge defining the opening, the assembly comprising:

a grommet formed of a resilient material and having a wall portion sized to be inserted into the shell wall opening and a flange portion extending from the wall portion and configured to overlay a portion of the tub shell about the opening, the grommet having an interior peripheral recess defined in the wall portion, the recess having a recess cross-sectional configuration, the recess spaced away from the flange portion by a sufficient distance that, when the grommet is inserted into the opening and the flange portion seated against the tub wall, the recess is at a position beyond the back surface of the tub shell;

a bathing installation fitting including a fitting body having a peripheral wall portion and a body flange portion extending outwardly from the wall portion, the peripheral wall surface having a protruding peripheral external rib about an exterior surface of the peripheral wall surface, the rib having a rib cross-sectional configuration complimentary to the recess cross-sectional configuration, the rib positioned on the fitting body so that when the fitting body is inserted into the grommet, the peripheral rib is received into the peripheral recess on the grommet;

the grommet and fitting configured such that the recess of the grommet and the fitting body rib are positioned below the back surface of the shell wall when installed in the opening, and the periphery of the grommet is compressed by the edge of the shell opening and pushed outwardly by the rib to form a protrusion area increasing a dimension of the grommet below the back surface of the shell to lock the fitting into the shell opening, the grommet forming a water seal against the tub shell wall such that the fitting assembly does not leak water when installed in the opening and the protrusion area locks the fitting assembly within the shell opening.

2. The assembly of claim 1, wherein the grommet is fabricated of EPDM.

3. The assembly of claim 1, wherein the fitting and grommet are configured for installation in a spa or whirlpool bath.

4. The assembly of claim 1, wherein the fitting is one of a water jet, a control panel, an air jet, a switch button, an audio speaker or a suction fitting.

5. The assembly of claim 4, wherein the grommet and the fitting each has a circular outer peripheral configuration.

6. A fitting assembly for installation in an opening in the tub shell wall of a bathing installation tub having an interior surface, a back surface and an edge defining the opening, the assembly comprising:

a grommet formed of a resilient material and having a wall portion sized to be inserted into the shell wall opening and a flange portion extending from the wall portion and configured to overlay a portion of the tub shell about the opening, the grommet having an interior peripheral recess defined in the wall portion, the recess having a flat surface on a top generally parallel to the flange portion and an inwardly tapered surface below the flat surface, the recess spaced away from the flange portion that, when the grommet is inserted into the opening and the flange seated against the tub wall, the recess is at a position beyond the back surface of the tub shell;

a bathing installation fitting including a fitting body having a peripheral wall portion and a body flange portion extending outwardly from the wall portion, the peripheral wall surface having a protruding peripheral external rib about an exterior surface of the peripheral wall surface, the rib having a flat top portion extending generally parallel to the body flange portion and a tapered portion extending below the flat portion, the rib positioned on the fitting body so that when the fitting body is inserted into the grommet, the peripheral rib is received into the peripheral recess on the grommet;

the grommet and fitting configured such that the recess of the grommet and the fitting body rib are positioned below the back surface of the shell wall when installed in the opening, and the periphery of the grommet is compressed by the edge of the shell opening and an unrestrained region of the grommet beneath the shell wall is pushed outwardly by the rib to form a protrusion area increasing a dimension of the grommet below the back surface of the shell to lock the fitting within the shell opening, the grommet forming a water seal against the tub shell wall such that the fitting assembly does not leak water when installed in the opening and the protrusion area locks the fitting assembly within the shell opening.

7. The assembly of claim 6, wherein the fitting is one of a water jet, a control panel, an air jet, a switch button, an audio speaker or a suction fitting.

8. The assembly of claim 6, wherein the grommet and the fitting each has a circular outer peripheral configuration.

9. The assembly of claim 6, wherein the grommet is fabricated of EPDM.

10. The assembly of claim 6, wherein the fitting and grommet are configured for installation in a spa or whirlpool bath.

11. A fitting assembly for installation in an opening in a tub shell wall of a bathing installation tub having an interior surface, a back surface and an edge defining the opening, the assembly comprising:

a grommet formed of a resilient material and having a wall portion sized to be inserted into the shell wall opening and a flange portion extending from the wall portion and configured to overlay a portion of the tub shell about the opening, the grommet having an interior peripheral grommet feature defined in the wall portion with a cross-sectional grommet feature configuration, the grommet feature spaced away from the flange portion by a sufficient distance that, when the grommet is inserted into the opening and the flange portion seated against the tub wall, the grommet feature is at a position beyond the back surface of the tub shell;

a bathing installation fitting including a fitting body having a peripheral wall portion and a body flange portion extending outwardly from the wall portion, the peripheral wall surface having a peripheral body feature on an exterior surface of the peripheral wall surface, the body feature having a body feature cross-sectional configuration complimentary to the grommet feature cross-sectional configuration and positioned on the fitting body so that when the fitting body is inserted into the grommet, the grommet feature and the body feature are engaged;

the grommet and fitting configured such that the grommet feature and the fitting body feature are positioned below the back surface of the shell wall when installed in the opening, and the periphery of the grommet is compressed by the edge of the shell opening and the engagement of the body and grommet features form a protrusion area increasing a dimension of the grommet below the back surface of the shell to lock the fitting into the shell opening, the grommet forming a water seal against the tub shell wall such that the fitting assembly does not leak water when installed in the opening and the protrusion area locks the fitting assembly within the shell opening.

12. The assembly of claim 11, wherein the fitting is one of a water jet, a control panel, an air jet, a switch button, an audio speaker or a suction fitting.

13. The assembly of claim 11, wherein the grommet and the fitting each has a circular outer peripheral configuration.

14. The assembly of claim 11, wherein the grommet feature is a recess, and the fitting body feature is a projection.

15. The assembly of claim 11, wherein the grommet feature is a projection, and the fitting body feature is a recess.

16. The assembly of claim 11, wherein the fitting and grommet are configured for installation in a spa or whirlpool bath.

* * * * *